United States Patent [19]

Burkhardt

[11] 4,083,505

[45] Apr. 11, 1978

[54] SPINNING MACHINE WITH THREAD APPLYING DEVICE

[75] Inventor: Klaus Burkhardt, Remscheid, Germany

[73] Assignee: Barmag Barmer Maschinenfabrik Aktiengesellschaft, Wuppertal, Germany

[21] Appl. No.: 654,620

[22] Filed: Feb. 2, 1976

[30] Foreign Application Priority Data

Jun. 14, 1975 Germany ..... 2526768
Aug. 4, 1975 Germany ..... 2534699

[51] Int. Cl.[2] ..... B65H 54/02; B65H 54/20

[52] U.S. Cl. ..... 242/18 PW; 242/35.5 R

[58] Field of Search ..... 242/18 PW, 18 DD, 35.5 R; 57/34 TT

[56] References Cited

U.S. PATENT DOCUMENTS 3,276,704 10/1966 Pabis ..... 242/18 PW
3,792,818 2/1974 Bauer et al. ..... 242/18 PW
3,964,721 6/1976 Owens et al. ..... 242/18 PW

*Primary Examiner*—Stanley N. Gilreath
*Attorney, Agent, or Firm*—Keil, Thompson & Shurtleff

[57] ABSTRACT

A thread applying device for a winding machine with one or more thread capturing grooves on a spool spindle or on one or more empty sleeves slipped onto this spindle. The device has a thread applying arm which carries open thread guides, extends along part of the length of the spool spindle and is supported for rocking movement about the empty sleeves and so that the thread guides execute a movement axial relatively to the spindle. In this manner the device makes possible single-handed thread application and insures that the threads in this applying operation encircle the empty sleeves over a relatively large angle and are safely moved into and captured by the capturing grooves. The formation of waste windings and thread reserves is also facilitated.

4 Claims, 10 Drawing Figures

SPINNING MACHINE WITH THREAD APPLYING DEVICE

Figure 1:
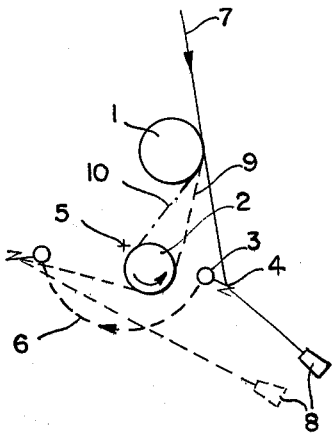

The invention relates to a winding machine for the winding of one or more threads, which has a spool spindle for receiving spool sleeves, with the spool spindle or the spool sleeves being provided with thread capturing devices, and has thread traversing devices for building up the bobbins. It is known to equip winding machines with devices for the applying or laying-on of thread, particularly winding machines of this kind which are designed to wind supplied threads continuously and at a high speed. Thread velocities of several thousand meters/minute are customary in the spinning of synthetic threads as well as in thread-stretching operations in modern textile plants. At such high thread velocities considerable difficulties are encountered by the operating personnel if auxiliary devices for the applying of thread are not used.

In German petty patent DT-Gm No. 1,913,238 a winding device has been disclosed for which an auxiliary device for the applying of two threads to two tubular spool carriers slipped onto a winding spindle has been proposed. In two of the embodiments described there the auxiliary device for applying the threads must be held and guided by the operating personnel until the threads have been seized by the thread-capturing grooves of the spool sleeve. In addition, the suction pistol into which the threads run until the beginning of the winding operation must be held by the operating personnel. In the auxiliary device held by the operating personnel for applying the threads there is mounted a pluse generator which, in response to the seizure of the threads by the thread-capturing grooves and the resultant rupture of the thread between the capturing groove and the suction pistol, transmits a pulse in wireless fashion, or by way of a line, to a receiver disposed in the machine. This receiver in turn causes the auxiliary thread guide for the formation of a thread reserve to be rocked about a rotational axis normal to the spool axis. This device is very cumbersome and expensive. Since, as described there, a threading device must also be used one operator alone is hardly sufficient to manipulate these auxiliary devices. There is the added disadvantage that the threads must be guided manually into the thread-capturing grooves in an axial direction.

In another embodiment the portable auxiliary device is inserted into a holder provided at the winding location in question, the threads are manually threaded into the auxiliary thread guides for the formation of the thread reserve and possibly are passed, with the aid of a threading device, between the traversing device and the drive roller for the spool, and are inserted into thread guiding slots of the auxiliary thread applying device. Now the rocking movement of the auxiliary thread guide for the formation of the thread reserve, about a rotational axis normal to the spool axis, is manually initiated. In the embodiment described there the rocking movement, however, serves only in part for the formation of the thread reserve. A first portion of the rocking movement, which is of indeterminate duration, serves to lay the threads guided around the drive roller, axially into the thread-capturing grooves. A disadvantage of this device consists in that the moment at which the threads are seized by the thread-capturing grooves in uncertain and hence the length of the formed thread reserves may differ considerably from spool to spool. In addition, the threading and inserting of the threads between the traversing device and the drive roller requires extreme care on the part of the operating personnel if the threads are not to be ruptured already prior to their application. The applying of the threads, therefore, is undesirably time consuming.

Underlying the present invention is the problem to provide winding machines with a device which automatically brings the thread to be applied, into operative connection with the driven bobbin carrier and the thread-capturing device so that the thread is seized and the spool formation begun independently of the skill of the operating personnel. The device is designed to insure rapid and reliable thread application in single-handed operation, particularly also in winding machines of the kind in which the thread is supplied at a high velocity, for example from a continuously operating spinning nozzle, and of the kind the spool spindles of which are designed to wind a plurality of threads simultaneously. Beyond this the device is designed to make possible when desired the formation of a thread reserve winding and, is required, also of a waste winding.

Briefly, the solution proposed according to the invention is a winding machine having a thread applying arm which extends along a part of the spool spindle and carries as many open thread guides as there are spools to be simultaneously wound on the spool spindle, with the thread guides being disposed at levels corresponding to the effective range of the thread-capturing devices, and which for the thread application is arranged for rocking movement about a rotational axis from a standby position to a rest position, with the corresponding axle being rotatably supported so that the spool spindle with the empty spool sleeves lies within the space circumscribed by the rocking movement of the thread applying arm and that the thread guides execute an axial movement relatively to the spool spindle. Since the thread applying operation takes place in a short time and with great reliability, it is possible to monitor and operate a great number of winding positions in this fashion.

The operator guides with one hand the thread suction pistol and has the other hand continuously free so as to be able to instantaneously take care of possible unstandard conditions, for example by the operation of push buttons. In this manner the time between the drawing off of one or more full spools and the termination of the thread applying operation is considerably shortened and hence the loss of thread material—which keeps being supplied in the meantime—is markedly reduced. According to an embodiment of the invention the axle of the thread applying arm may be supported rotatably and axially displaceably relatively to the spool spindle, in such a manner that the threads which due to the rocking movement of the thread applying arm touch the circumferential surface of the spool sleeves, are brought into the effective range of the thread-capturing device. Since the rocking movement is thus followed by an axial movement of the thread applying arm it is insured that the threads at the time when they axially cross the thread-capturing devices, encircle the peripheral surface at a relatively great circumferential angle and are thus seized by the thread-capturing device with great safety.

Particularly rapid and safe application of the threads is attained by an embodiment in which the axle of the thread applying arm may be rotatably and axially displaceably supported in a bearing bushing having a thread-like guide slot into which extends a guide pin radially secured to the axle.

According to a further embodiment which is especially simple and inexpensive in manufacture, the axle of the thread applying arm may be spatially supported in relation to the spool spindle axis in such a way that, in top view projection, it intersects the extension of the spool spindle axis, whereby incident to the rocking movement of the thread applying arm an axial motion component relatively to the spool spindle is imparted to the thread guides and hence the threads to be applied. By means of this solution it is possible to insure in a simple manner at the moment when the threads, in moving in axial direction, cross or pass the thread-capturing grooves, the encircling angle of the threads on the sleeve surfaces is sufficiently large. A certain minimum amount of encircling angle is necessary to insure safe capture of the threads by the thread-capturing grooves.

According to an advantageous further development of the invention, the thread applying arm may be supported by a slide which carries self-threading thread traversing guides, drivable auxiliary thread guides for the formation of waste windings and thread reserves, as well as a driving device for the rocking movement of the thread applying arm which is arranged to be started from the support slide as it moves into winding position; the driving device for the axial movement may be arranged to be started independently thereof and may be connected with the driving device for the auxiliary thread guides by way of time delay elements with an adjustable delay time.

In a further implementation of the winding machine according to the invention the driving device common to the rocking movement and axial movement of the thread applying arm may be connected with the driving device for the auxiliary thread guides through the medium of a time delay element with an adjustable delay time. These further developments make it possible to form with the aid of the auxiliary thread guides and the associated driving devices, thread reserves prior to the beginning of the winding operation proper. By means of the time delay elements of a control apparatus a waste winding may, selectively, be suppressed altogether or its extent may be established between a minimum number of turns and a chosen maximum number of turns.

Figure 5:
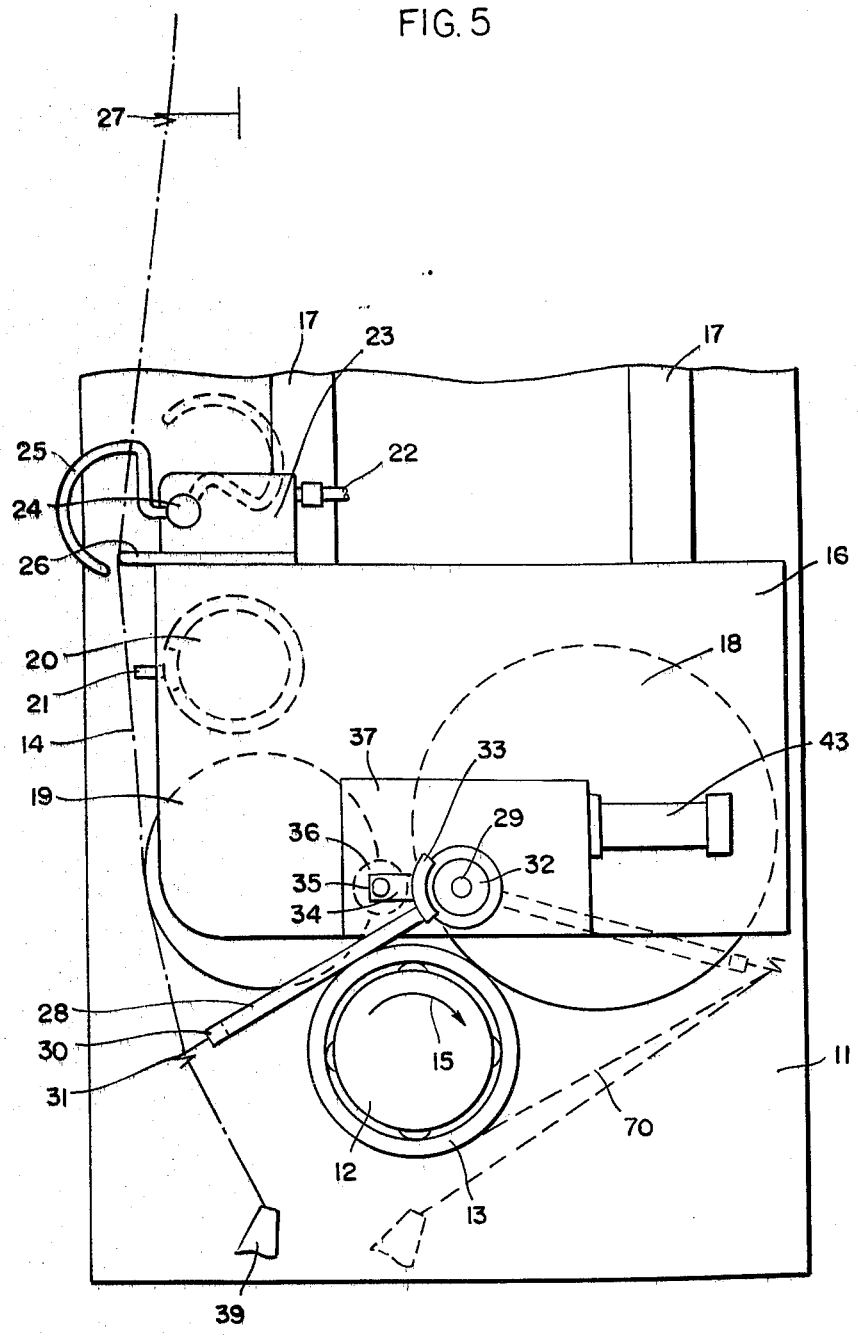
Figure 6:
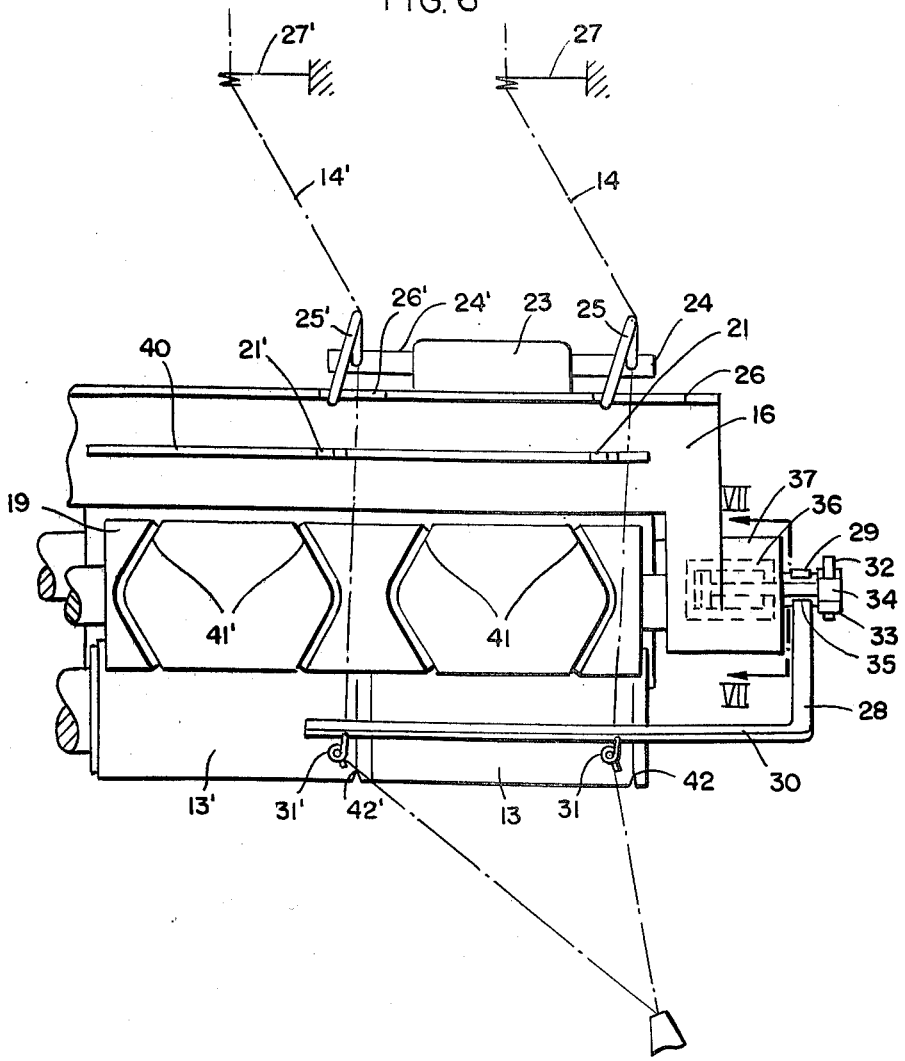
Figure 7:
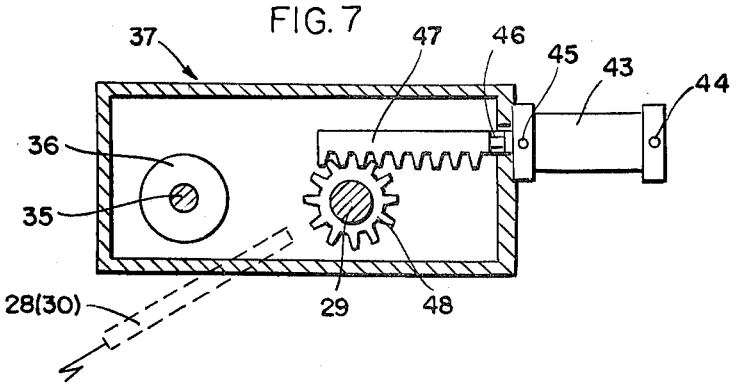
Figure 8:
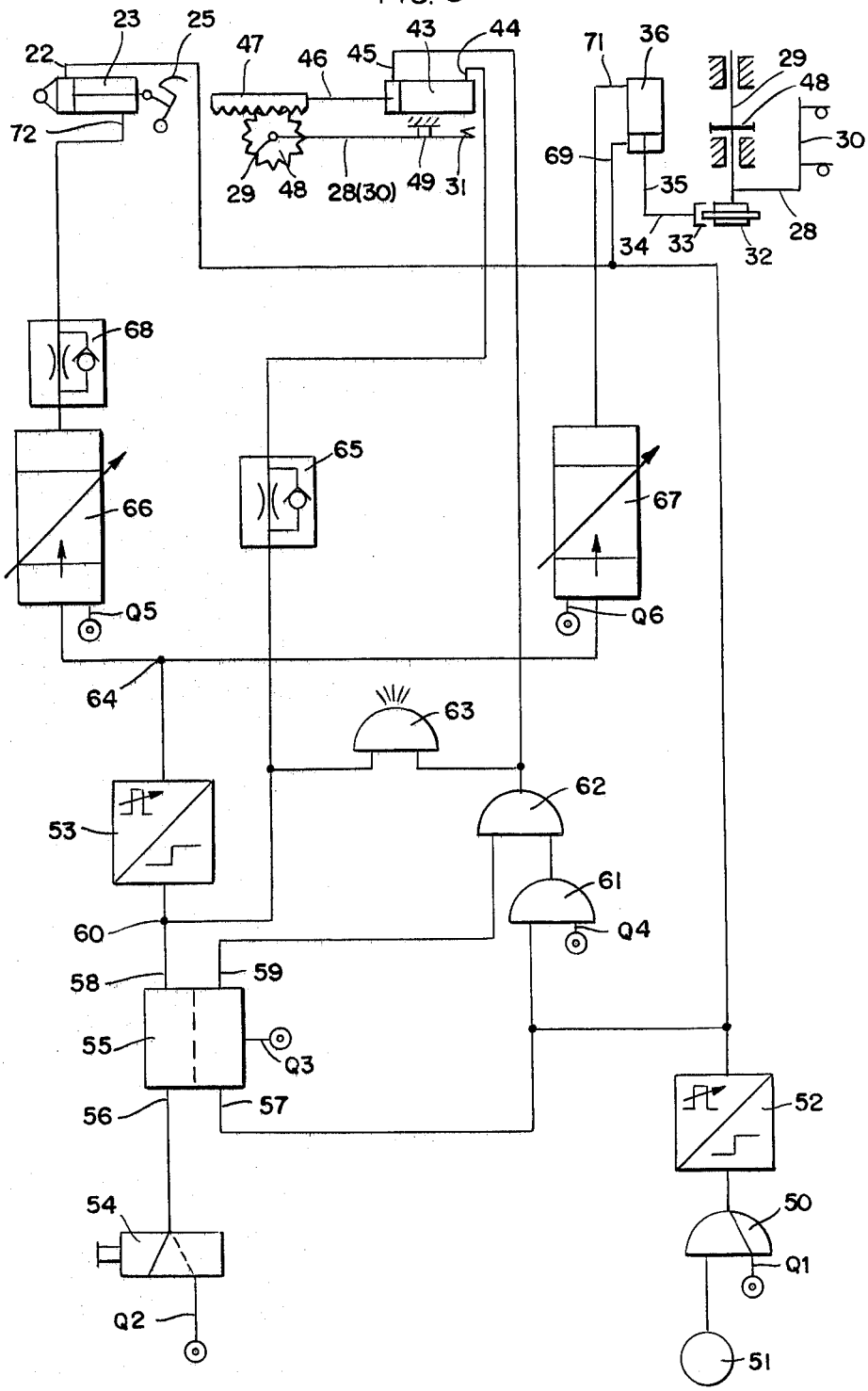
Figure 9:
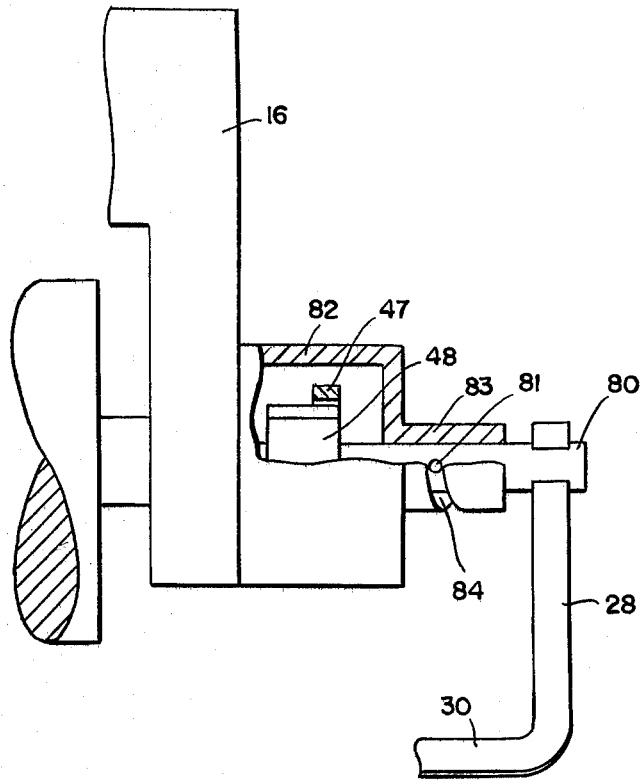
Figure 10:
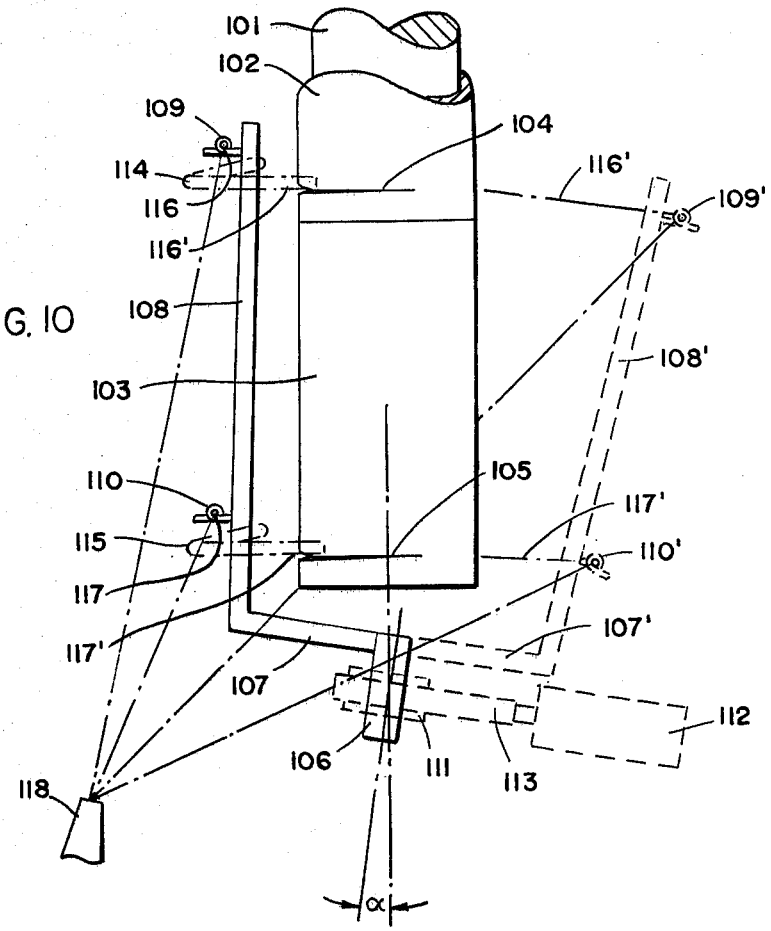

Embodiments of the invention have been schematically shown in the drawings in which:

FIGS. 1 to 4 are diagrammatic representations of several possible applications for the device according to the invention, FIG. 5 is the front view of a winding apparatus embodying the thread applying device according to the invention, FIG. 6 is a side view of the same winding apparatus, FIG. 7 is a part section VII—VII as taken in FIG. 6, FIG. 8 is the circuit diagram of a control apparatus, FIG. 9 is a part section through portions, essential to the invention, of a further embodiment, and FIG. 10 is the plan view of a further embodiment.

In the representations of FIGS. 1 to 4, 1 generally denotes a traversing device which may be in the form of a slotted drum or a groove roller or also a reversing type tracking roller driving a traversing thread guide. Ref. 2 denotes a spool spindle on which one or more empty spool sleeves—briefly referred to hereinafter also as "empty sleeves"—may have been slipped. Apart from cylindrical cardboard sleeves, other customary bobbin carriers such as disk spools may also be used. Essential for the function of the thread applying device of the invention is that either the spool spindle or the bobbin carriers themselves are provided with devices for the automatic capturing and clamping of threads or thread ends. Examples for such known thread-capturing devices are notches or circumferential grooves of cuniform cross-section in cylindrical or conical sleeves of cardboard or plastic material. The direction of rotation of spool spindle 2 or of the bobbin carrier is indicated by an arrow not particularly designated.

The spool spindle or the bobbin carriers may be driven directly or by friction at their circumference by means of a drive roller. Thread applying arm 3 carries as an essential component of the thread applying device as many open thread guides 4, for example pigtails, as there are bobbin carriers slipped onto spool spindle 2. The track line of the rocking movement of thread applying arm 3 about the center or axis 5 of rotation is represented by a section 6, shown in broken lines, of a circular arc. An arrow on arc section 6 indicates the direction of the rocking movement in applying the thread or threads 7 onto the empty spools slipped on spool spindle 2. The direction of travel of threads 7 is indicated by an arrow on the thread travel path. Threads 7 are continuously supplied, for example, from spinning nozzles. In the time interval between the severing of threads 7 from full spools to be withdrawn from spool spindle 2 and their seizure by the thread-capturing devices (FIG. 6) of the newly slipped-on empty sleeves, threads 7 run into a thread suction pistol 8 which may be connected with a waste thread-collecting bin.

Figure 2:
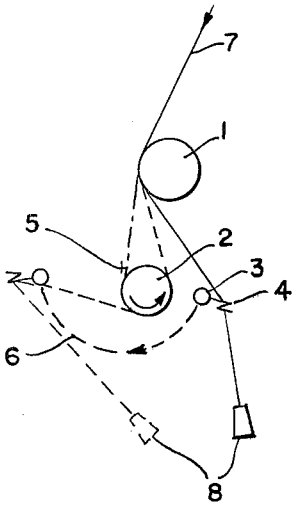
Figure 3:
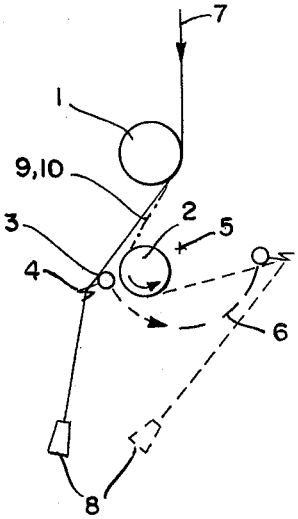
Figure 4:
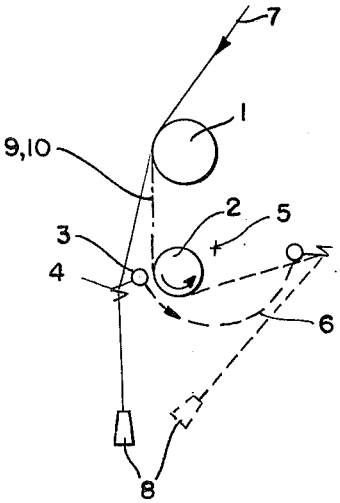

In FIGS. 1 and 2 the movements of spool spindle 2 and threads 7 are in mutually opposite directions at their common points of contact. As a result, the application plane 9 (shown in broken lines) and the traversal plane 10 (shown in dot-dash lines) differ from each other, the latter plane being automatically assumed by threads 7 after they have been seized by the thread-capturing device (the thread applying operation will be discussed in detail below with reference to an embodiment of this device which has been reduced to practice). In the application scheme according to FIGS. 3 and 4, threads 7 and spool spindle 2 run in the same direction in their common points of contact. As a consequence applying plane 9 and traversing plane 10 are identical in this instance. Apart from the arrangements shown schematically in FIGS. 1 to 4, further known winding apparatus are conceivable in which the thread applying device of the invention may be employed.

As shown in FIG. 5, spool spindle 12 which is in the form of a spool chuck is supported for rotation in machine frame 11. Several, preferably one to four, spool sleeves or empty sleeves 13 for the reception of threads 14 may have been slipped on spool spindle 12. The direction of rotation of spool spindle 12 has been indicated by arrow 15. It will be appreciated that the front view, FIG. 5, of the embodiment described in detail hereinafter, corresponds in substance to the arrangement schematically shown in FIG. 1 if this latter figure is looked at as a simplified mirror-image version—or, for that matter, a simplified rear view presentation—of the embodiment according to FIG. 5. Reference may also be made at this point to U.S. Pat. No. 3,792,818 which issued to Bauer et al. on Thread Reserve-Forming Devices on Feb. 19, 1974. While the present application is self-explanatory to persons skilled in the art the contents of the aforementioned patent may be helpful as background information regarding the general organization of the winding apparatus contemplated herein and should thus be regarded as incorporated in the present patent application for purposes of disclosure.

A support slide 16 is slidably guided for lifting or lowering movement in grooves 17 of machine frame 11. The lifting or lowering of support slide 16 may be effected, for example, by a pneumatically actuated driving apparatus—not shown as it is not essential for the invention. In support slide 16 drive roller 18, groove roller 19 and reversing type tracking roller 20 are mounted for rotation. Rollers 18, 19 and 20 may be driven independently of each other or they may be connected with a common drive by way of a corresponding transmission. Drive roller 18 is in circumferential contact with empty sleeve 13 or with the yarn bobbin wound thereupon, whereby the spool and spool spindle 12 are driven. Groove roller 19 may have one or more thread guiding grooves extending over the entire winding range or ranges of the bobbins to be formed; alternatively, it may merely have traversing groove sections, particularly for the ends of the winding range. Reversing type tracking roller 20 has as many reversing tracks, each closed in itself, and hence it drives as many traversing thread guides 21 as there are threads 14 to be wound on spool sleeves 13.

On support slide 16 there is mounted a device by means of which prior to the winding of each main bobbin a thread reserve and, if desired, also a waste winding may be formed on the spool sleeves. This device consists substantially of a drive unit which may be implemented as a rotary piston/cylinder unit 23 charged with air under pressure by way of line 22. Instead of rotary piston/cylinder unit 23 any other customary and suitable driving device may also be used (compare the axially movable piston in the circuit diagram according to FIG. 8). Mounted on rotary piston rod 24 are as many hook-shaped auxiliary thread guides 25 as there are threads 14 to be wound. Thread deflecting bars 26 insure that the threads 14 coming from the stationary thread guides 27 are not engaged by the self-threading traversing thread guides already prior to the beginning of the main winding operation.

The thread applying device consists substantially of rocking arm 28 which is radially mounted on axle 29, and of thread applying arm 30 (FIG. 6) which is carried by rocking arm 28 and extends parallel to the axis of spool spindle 12, and which has as many open thread guides 31 as there are threads 14 to be wound by spool spindle 12. Mounted on axle 29 is a shifting disk 32. The collar-like offset marginal portion of this disk is embraced by a shifting fork 33 which in turn is connected with a piston rod 35 by way of a shifting arm 34 (for the sake of clarity the upper end of shifting fork 33 has been shown broken off in FIG. 6). Piston rod 35 is part of a cylinder/piston unit 36 which serves as the driving device for the axial movement of thread applying arm 30 (see FIGS. 6, 7 and 8). Cylinder/piston unit 36 and drive devices 43 for the rocking movement of thread applying arm 30 are mounted in or on the housing 37 which in turn is secured to support slide 16. (These devices will be discussed in more detail hereinbelow with reference to FIG. 7). The thread suction pistol has been designated by reference numeral 39.

The side view according to FIG. 6 substantially shows the same elements as FIG. 5. In addition, the following further details have been shown in FIG. 6: the longitudinal guideway 40 for traversing thread guides 21 and 21' which is in the form of a slot, thread guide groove sections 41 and 41' of roller 19 at the stroke reversal ends of the thread traversal, and thread-capturing grooves 42 and 42' in the still empty spool sleeves 13 and 13'. As will become clearer from the description given hereinbelow of the operation of the device according to the invention, FIG. 6 shows the thread applying arm in its rotary and axial standby position into which it has been initially moved. This standby position was earlier assumed by the thread applying arm in response, first, to an axial movement of this arm while in rotary rest position—the dotted-line position in FIG. 5—, from right to left as viewed in FIG. 6, and then by a rocking movement of the arm, in a clockwise direction as viewed in FIG. 5, into the fully drawn-out rotary position shown there, all as described below. Prior to the arrival of arm 30 in its standby position threads 14,14' have been threaded into open thread guides 31,31' as shown. It will also be noted from FIG. 6 that in this standby position the last-mentioned guides are at a level located between the respective thread capturing device 42,42' and the adjacent end, defined by groove sections 41,41', of the respective main winding to be formed.

The section shown in FIG. 7 substantially shows the driving devices for thread applying arm 28,30. Adjacent to cylinder/piston unit 35,36 for the axial drive of thread applying arm 28,30, housing 37 contains driving elements for the rocking movement of thread applying arm 28,30. Mounted on housing 37 is cylinder/piston unit 43 with compressed air supply connections 44 and 45. The piston rod 46 on its axial extension carries a rack 47 which engages pinion 48. Pinion 48 is fixedly secured to axle 29 on which thread applying arm 28,30 is mounted (FIGS. 5 and 6). The axial movement of piston rod 46 is translated by way of rack 47 and pinion 48 into the rocking movement for thread applying arm 30. For improved clarity the compressed air connections for cylinder/piston unit 35,36 have not been shown.

The circuit diagram of FIG. 8 illustrates the pneumatic control apparatus for cylinder/piston units 23,43 and 36. Cylinder/piston unit 23 which in contrast to its representation in FIG. 5 is shown here in the form of an axially acting piston unit, effects the rocking of auxiliary thread guides 25 from their normal position into the thread traversal plane and back. Cylinder/piston unit 36 shifts axle 29 by way of piston rod 35, shifting arm 34, shifting fork 33 and shifting disk 32 in axial direction—at one time for the execution of the operating stroke of the thread applying arm 30 mounted thereon and at another time for the restoration of the thread applying arm 30 into its standby position. To this end shifting disk 32 is fixedly mounted on axle 29, that is, non-translatably and non-rotatably with respect to axle 29. Pinion 48 which is also fixedly mounted on axle 29 is wide enough that its teeth are in uninterrupted engagement with rack 47, independently of the axial position of axle 29. (In the circuit diagram according to FIG. 8 pinion 48 has been shown twice, namely first in its relation to cylinder/piston unit 36 and then again in its relation to cylinder/piston unit 43.) In the showing (wiring diagram according to FIG. 8) of axle 29 and rocking arm 28 in relation to cylinder/piston unit 43, thread applying arm 28,30 has been drawn in its rotary rest position wherein it abuts against stop 49. In this rotary rest position, however, it executes the axial movement by which the threads are guided into thread-capturing grooves 42 or 42' (FIG. 6).

Important elements of the control apparatus are YES-element or normally closed valve 50 which, through operation of limit switch 51, is connected with the source of compressed air by way of line Q1, two pulse generators 52 and 53 the pulse duration of which is adjustable, as well as signal store 55 and time switches 66 and 67. By means of the operation of push button switch 54 signal store 55 can be connected via line Q2 with the source of compressed air so as to have a signal impressed on its input 56. The second signal input of store 55 is designated with numeral 57 and the outputs with 58 and 59. The junction point between output 58 of store 55 and pulse generator 53 is designated as 60. Further control elements are NOT-element or normally open valve 61 as well as the two AND-elements 62 and 63.

The junction point following pulse generator 53 is designated as 64. Between junction point 60 and compressed air connection 44 of cylinder/piston unit 43 a pressure regulating valve 65 is interposed in the compressed-air line. The pulses originating from pulse generator 53 are passed by way of time switches 66 and 67 to cylinder/piston unit 23 and to cylinder/piston unit 36 upon the lapse of predetermined time delays which are adjustable by means of the time switches.

The time delays are chosen so that the rocking movement of auxiliary thread guides 25,25' (FIG. 6) as effected by cylinder/piston unit 23 is terminated only after termination of the axial movement, initiated by cylinder/piston unit 36, for the insertion of threads 14,14' into thread-capturing grooves 42, 42'. Between time switch 66 and cylinder/piston unit 23 a pressure regulating valve element 68 is interposed in the compressed-air line. The velocities of the associated pistons are determined by a corresponding adjustment of pressure regulating valves 65 and 68.

Prior to the beginning of a new winding operation support slide 16 has moved upwardly into its normal position so that the exchange of the full spool for empty spool sleeves 13 can take place without interference. In this initial position the already running drive roller 18 is out of contact with empty sleeves 13 and thread applying arm 30 is in its rest position shown in broken lines in FIG. 5; as far as its axial position is concerned, thread applying arm 30 is in its rest position, that is, in the end position of its operating stroke. The term operating stroke is meant to denote the movement of the thread applying arm 30 by which the threads are urged, axially of the spools, in the direction of, or into, the thread-capturing grooves. Cylinder/piston unit 36 which gives rise to this operating stroke, in the rest position of the thread applying arm 28, 30 is vented on both sides of the piston, whereas cylinder/piston unit 43 on one side is charged by air under pressure in such a way that thread applying arm 30 is held in its rest position (shown in broken lines in FIG. 5). Auxiliary thread guides 25, 25' are in their rest position which is indicated in FIG. 5 by broken lines. Cylinder/piston unit 23 for the actuation of auxiliary thread guides 25, 25' is vented on both sides. Threads 14 and 14' which may be incoming from spinning nozzles, for example, are guided through stationary thread guides 27 and 27' (FIGS. 5 and 6) and run into thread suction pistol 39 whence they are conveyed into a waste collection bin.

At the beginning of a new winding operation support slide 16 is lowered. Shortly before or upon arrival in its operating position—which is the position in which drive roller 18 is in driving contact with empty spool sleeves 13, 13'—support slide 16 actuates a limit switch 51 shown, schematically, only in FIG. 8. Pulse generator 52 is triggered to transmit a pulse. This pulse for one thing causes air under pressure to be connected via connection 69 to cylinder/piston unit 36 so that thread applying arm 30 is axially moved into its standby position, that is, its initial position for the operating stroke; and for another thing it causes cylinder/piston unit 23 to be connected to compressed air via line 22 such that auxiliary thread guides 25, 25' are rocked into the traversal plane (shown in full lines in FIGS. 5 and 6). In addition, the pulse received via input 57 is stored in store 55 and a signal is transmitted to AND-element 62 by way of line Q3 and output 59.

In the meantime drive roller 18 has been placed into driving contact with empty sleeves 13 and 13' and the pulse sent by pulse generator 52, the duration of which has been limited by prior adjustment, is now terminated. In this manner the second input of AND-gate 62 receives air under pressure from line Q4 by way of NOT-element 61; the gate cuts through and connects air under pressure to cylinder/piston unit 43 via connection 45 in such a way that piston rod 46 rotates axle 29 in clockwise direction by way of rack 47 and pinion 48 whereby thread applying arm 28, 30 which is mounted on axle 29 is rocked into its standby position (fully drawn lines in FIGS. 5 and 6). Cylinder piston units 36 and 23 have now been vented by way of connections 69 and 22, respectively. After threads 14 and 14' coming from stationary thread guides 27 and 27' and lying against the right hand run-off edges of auxiliary guides 25 and 25' have been threaded into open-thread guides 31 and 31' as shown in dot-dash lines in FIGS. 5 and 6, push button switch 54 only shown in the circuit diagram of FIG. 8 is actuated by the operating personnel. In this manner store 55 is set by way of input 56 and air under pressure is connected to pulse generator 53 and, simultaneously, from junction point 60 via pressure regulating valve 65 and connection 44 to cylinder/piston unit 43. The piston of this unit moves piston rod 46 and hence rack 47 so that pinion 48 rocks axle 29 in counterclockwise direction until thread applying arm 28, 30 which is mounted on axle 29, abuts against stop 49. In the process threads 14 and 14' guided through thread guide eyes 31 and 31' are taken along and, as shown by the dot-dash line in FIG. 5, are brought into contact with the circumference of empty sleeves 13 and 13' between the main winding range of spool sleeves 13 and 13' (dot-dash lines, FIG. 6) and thread-capturing grooves 42 and 42'. Simultaneously with the charging of cylinder/piston unit 43 via connection 44 the cylinder on the other side of the piston is vented by way of connection 45 and AND-element 63, since the second input of the latter received a signal.

The signal triggering the rocking movement of thread applying arm 28, 30 caused pulse generator 53 to transmit a pulse from junction point 64 to time switches 66 and 67. Owing to the above-mentioned different delay time adjustments of time switches 66 and 67, cylinder/piston unit 36 is first charged with compressed air via connection 71 so that thread applying arm 28, 30 mounted on axle 29 is axially displaced by piston rod 35 by way of shifting arm 34, shifting fork 33 and shifting disk 32. In this way, threads 14 and 14' which are taken along by thread guides 31 and 31' are shoved into thread-capturing grooves 42 and 42', are seized by these grooves and are ruptured between the thread-capturing grooves and thread suction pistol 39. On empty sleeves 13 and 13' there begins now the formation, if desired, of waste windings until, due to the charging of cylinder/-piston unit 23 with compressed air via connection 72, auxiliary thread guides 25 and 25' are rocked out of the traversal plane. Whether a waste winding is desired and, if so, how many turns of thread this winding is to have may be determined, at will, by a corresponding preadjustment of the difference in delay times between time switches 66 and 67.

Threads 14 and 14' coming from stationary thread guides 27 and 27' and lying against the sides of auxiliary thread guides 25 and 25' now slide along the run-off edge of the auxiliary thread guides during the rocking movement of the latter until they slide off the free ends of the auxiliary thread guides and, because of their tension, pass into the traversal range of thread traversing guides 21 and 21'. Until such time as threads 14 and 14' thread themselves automatically into thread traversing guides 21 and 21', several turns of thread are deposited on the spool sleeve as a thread reserve. Due to the helical or thread-like formation of auxiliary thread guides 25 and 25', the individual turns of the thread reserve winding come to lie adjacent each other with a clearly visible separation so that the end of the thread can easily be found when it is later to be tied to a succeeding spool. Auxiliary thread guides 25 and 25' rock into their rest position indicated by broken lines in FIG. 5. In this position they may abut against a stop not shown. As soon as the pulse transmitted by pulse generator 53 is terminated because of its adjusted time limitation, cylinder/piston units 23 and 36 are automatically vented by way of pulse generator 53. The pistons of all cylinder/piston units and all switching elements of the control apparatus now remain in their present conditions until the end of the winding operation just begun.

The embodiment according to FIG. 9 differs from that shown in FIGS. 5 to 8 substantially in that cylinder/piston unit 43 (illustrated in FIG. 7 but not in FIG. 9) serves as the sole driving device for the movements of thread applying arm 28, 30. The cylinder/piston unit 36 as used in the embodiment of FIGS. 5 to 8 is dispensed with. An axle 80 (comparable to the axle 29 in the above-described embodiment) carries thread applying arm 28, 30. Pinion 48 which is fixedly mounted on axle 80 is rotatably driven at a limited angle of rotation by piston/cylinder unit 43 by way of rack 47 (compare FIG. 7). A guide pin 81 is permanently and radially inserted in axle 80. Housing 82 has a bearing bushing 83 in which axle 80 is supported for rotation and axial displacement. Guide pin 81 enters a curve-shaped guide slot 84 which is formed in the wall of bearing bushing 83. Instead of bearing slot 84 a similarly formed guide groove may be provided. Guide slot or guide groove 84 may have the curvature of the section of a thread or of a coarse thread.

When rotated by the driving device (cylinder/piston unit 43, FIG. 7) not shown in FIG. 9, by way of rack 47 and pinion 48 axle 80, due to pin 81 being guided in guide curve 84, executes the axial movement required to bring the threads to be applied, into the range of the thread-capturing device. Otherwise, the thread applying operation takes place as described above.

In addition to the driving device for the axial movement (cylinder/piston unit 36), the YES-element 50, pulse generator 52, NOT-element 61, the AND-element 62 and 63 as well as one of the time switches, 67, are eliminated in the control apparatus.

FIG. 10 shows, in a plan view, only the essential parts of the device. Of the devices located above the spool spindle, such as for example auxiliary thread guides for the formation of the thread reserve, the traversing devices with their driving elements and the drive roller, only the two auxiliary thread guides for the formation of the thread reserve have been indicated by dot-dash lines. Spool spindle 101 which at the same time may be implemented as a spool chuck carries, in the embodiment shown, two empty spool sleeves 102 and 103 (empty sleeves). Spool spindle 101 can hold up to four shorter empty sleeves. Empty sleeves 102 and 103 are provided at one end with thread-capturing grooves 104 and 105.

The thread applying device consists essentially of axle 106, radial arm 107 and thread applying arm 108 with the open thread guide eyes 109 and 110. Pinion 111 indicated in broken lines is fixedly mounted on axle 106 and may be rotatably driven by a rack 113 moved by means of cylinder/piston unit 112. For the sake of clarity, the bearing support for axle 106 has not been shown.

Auxiliary thread guides 114 and 115 illustrated in broken lines are mounted on a support slide, not shown, which is disposed above the spool spindle and may be lifted and lowered. In connection with the thread applying device the function of auxiliary thread guides 114 and 115 is of interest here only insofar as they hold threads 116 and 117 coming from the stationary thread guides, not shown, in the illustrated position prior to, and during, the thread applying operation.

At the beginning of the thread applying operation threads 116 and 117, coming for example from spinning nozzles and running into a portable thread suction pistol 118, after having traversed the stationary thread guide eyes not shown, are laid sidewise against auxiliary thread guides 114 and 115 (as shown in FIG. 10) and are threaded into the open thread guiding eyes 109 and 110. Each of the stationary thread guides not shown is disposed in the center of its associated bobbin winding range so that the tensioned threads 116 and 117 are deflected by the auxiliary thread guides 114 and 115 in the direction away from the center of the traversing stroke. The piston in cylinder/piston unit 112 may be charged by the operating personnel with air under pressure or oil under pressure by the depression of a push button whereby thread applying arm 107, 108 is rocked along the underside of spool spindle 101 from the position shown in FIG. 10 in fully drawn lines into the broken line position 107', 108'. In the initial position (fully drawn lines) of thread applying arm 107, 108 the open thread guide eyes 109, 110 lie at the level of the range between the thread-capturing grooves 104, 105 on the one hand and the associated winding ranges of empty sleeves 102, 103 on the other hand; due to the inclined orientation of axle 106—a relatively small angle $\alpha$ is sufficient for this purpose—thread guide eyes 109' and 110' travel, with the rocking movement, axially towards the end of the associated empty sleeve 102, 103 so that threads 116, 117 guided by thread guide eyes 109, 110 pass, and are safely seized by, thread-capturing grooves 104, 105 shortly before reaching the broken line position of thread applying arm 107', 108'.

In order that all the threads to be applied are seized by their associated thread-capturing grooves as simultaneously as possible, it is desirable that the acute angle between the spool spindle and the position, shown in broken lines, of the thread applying arm (not designated) be relatively small. As soon as the threads have been seized by thread-capturing grooves 104 and 105, the threads rupture between the thread suction pistol 118 and the thread-capturing grooves 104 and 105; the formation of the thread reserve now begins due to the fact that auxiliary thread guides 114 and 115 are moved out of the traversal plane so that threads 116' and 117', by virtue of their tension, travel towards the center of their respective winding ranges and are seized in these ranges by the thread traversing guides not shown.

I claim:

1. In a winding machine for the winding of a number of threads, said winding machine being of the type having a spool spindle arranged to receive a corresponding number of spool sleeves, and having a corresponding number of thread traversing devices for building up a respective bobbin, each of said spool sleeves being provided, at a predetermined position axially of said spindle, with a thread-capturing device, the improvement that there are provided movable thread applying means for automatically causing said number of threads to execute a movement about as well as axially of said spindle, said movable means including a thread applying arm extending along at least a part of the length of the spool spindle and supported for rocking movement about a rotational axis such that the spool spindle with said number of empty spool sleeves thereon lies within the space circumscribed by said rocking movement, and as many open thread guides carried by said arm as there are spools simultaneously wound on said spindle, that there are provided means for rocking said thread applying arm with said open thread guides thereon from a first rotational position in which each said thread is free of the circumferential surface of the corresponding spool sleeve, to a second rotational position in which each said thread contacts said circumferential surface, and moving, in automatically timed relationship to said rocking movement, each said thread guide axially in relation to the spool spindle from a first axial position in which each said thread is disposed at a position outside the respective bobbin winding range and also outside the effective range of the respective capturing device, to a second position in which each said thread is at a position within the last-mentioned effective range so that, incidentally to said axial movement, each said thread is captured by its respective capturing device, that each said open thread guide is fixedly secured to said thread applying arm, that said thread applying arm is mounted on an axle supported, for rotation and for axial displacement relatively to the spool spindle, in a bearing bushing having a thread-like guide slot, and that there is radially secured to said axle a guide pin which extends into said guide slot.

2. In a winding machine for the winding of a number of threads, said winding machine being of the type having a spool spindle arranged to receive a corresponding number of spool sleeves, and having a corresponding number of thread traversing devices for building up a respective bobbin, each of said spool sleeves being provided, at a predetermined position axially of said spindle, with a thread-capturing device, the improvement that there are provided movable thread applying means for automatically causing said number of threads to execute a movement about as well as axially of said spindle, said movable means including a thread applying arm extending along at least a part of the length of the spool spindle and supported for rocking movement about a rotational axis such that the spool spindle with said number of empty spool sleeves thereon lies within the space circumscribed by said rocking movement, and as many open thread guides carried by said arm as there are spools simultaneously wound on said spindle, that there are provided means for rocking said thread applying arm with said open thread guides thereon from a first rotational position in which each said thread is free of the circumferential surface of the corresponding spool sleeve, to a second rotational position in which each said thread contacts said circumferential surface, and moving, in automatically timed relationship to said rocking movement, each said thread guide axially in relation to the spool spindle from a first axial position in which each said thread is disposed at a position outside the respective bobbin winding range and also outside the effective range of the respective capturing device, to a second position in which each said thread is at a position within the last-mentioned effective range so that, incidentally to said axial movement, each said thread is captured by its respective capturing device, and that said rocking and axially moving means include means mounting said thread applying arm on an axle supported at an angle to the axis of the spool spindle in such a way that, in plan view projection the axis of said axle intersects the extension of the spool spindle axis, whereby incident to the rocking movement of the thread applying arm an axial motion component relatively to the spool spindle is imparted to each of the threads to be applied.

3. In a winding machine for the winding of a number of threads, said winding machine being of the type having a spool spindle arranged to receive a corresponding number of spool sleeves, and having a corresponding number of thread traversing devices for building up a respective bobbin, each of said spool sleeves being provided, at a predetermined position axially of said spindle, with a thread-capturing device, the improvement that there are provided movable thread applying means for automatically causing said number of threads to execute a movement about as well as axially of said spindle, said movable means including a thread applying arm extending along at least a part of the length of the spool spindle and supported for rocking movement about a rotational axis such that the spool spindle with said number of empty spool sleeves thereon lies within the space circumscribed by said rocking movement, and as many open thread guides carried by said arm as there are spools simultaneously wound on said spindle, that there are provided means for rocking said thread applying arm with said open thread guides thereon from a first rotational position in which each said thread is free of the circumferential surface of the corresponding spool sleeve, to a second rotational position in which each said thread contacts said circumferential surface, and moving, in automatically timed relationship to said rocking movement, each said thread guide axially in relation to the spool spindle from a first axial position in which each said thread is disposed at a position outside the respective bobbin winding range and also outside the effective range of the respective capturing device, to a second position in which each said thread is at a position within the last-mentioned effective range so that, incidentally to said axial movement, each said thread is captured by its respective capturing device, that each said open thread guide is fixedly secured to said thread applying arm, that said thread applying arm is mounted on an axle supported, for both rotation and axial displacement relatively to the spool spindle, in a slide which carries self-threading thread traversing guides, auxiliary thread guides, driven by a first driving device, for the formation of waste windings and thread reserves, as well as a second driving device for the rocking movement of the thread applying arm and a third driving device for the axial movement of said arm, that there are provided control means including means for actuating said second driving device from the support slide as it moves into winding position and for actuating said third driving device independently of the actuation of said second driving device, and that the control means for at least said first driving device for the auxiliary thread guides further include time delay means with an adjustable delay time for delaying the response of said first driving device with respect to said third driving device.

4. In a winding machine for the winding of a number of threads, said winding machine being of the type having a spool spindle arranged to receive a corresponding number of spool sleeves, and having a corresponding number of thread traversing devices for building up a respective bobbin, each of said spool sleeves being provided, at a predetermined position axially of said spindle, with a thread-capturing device, the improvement that there are provided movable thread applying means for automatically causing said number of threads to execute a movement about as well as axially of said spindle, said movable means including a thread applying arm extending along at least a part of the length of the spool spindle and supported for rocking movement about a rotational axis such that the spool spindle with said number of empty spool sleeves thereon lies within the space circumscribed by said rocking movement, and as many open thread guides carried by said arm as there are spools simultaneously wound on said spindle, that there are provided means for rocking said thread applying arm with said open thread guides thereon from a first rotational position in which each said thread is free of the circumferential surface of the corresponding spool sleeve, to a second rotational position in which each said thread contacts said circumferential surface, and moving, in automatically timed relationship to said rocking movement, each said thread guide axially in relation to the spool spindle from a first axial position in which each said thread is disposed at a position outside the respective bobbin winding range and also outside the effective range of the respective capturing device, to a second position in which each said thread is at a position within the last-mentioned effective range so that, incidentally to said axial movement, each said thread is captured by its respective capturing device, that each said open thread guide is fixedly secured to said thread applying arm, that each said thread applying arm is mounted on an axle supported, for both rotation and axial displacement relatively to the spool spindle, in a slide which carries self-threading thread traversing guides, auxiliary thread guides, driven by a first driving means, for the formation of waste windings and thread reserves, as well as a second driving means common to the rocking movement and axial movement of the thread applying arm, and that there are provided control means for said driving means, the control means for said first driving means for the auxiliary thread guides including time delay means with an adjustable time delay for delaying the response of said first driving means with respect to said second driving means.

* * * * *